US010533811B2

(12) United States Patent
Hu et al.

(10) Patent No.: US 10,533,811 B2
(45) Date of Patent: Jan. 14, 2020

(54) HEAT DISSIPATION DEVICE

(71) Applicants: Avary Holding (Shenzhen) Co., Limited., Shenzhen (CN); HongQiSheng Precision Electronics (QinHuangDao) Co., Ltd., Qinhuangdao (CN)

(72) Inventors: Xian-Qin Hu, Shenzhen (CN); Fu-Yun Shen, Shenzhen (CN); Ming-Jaan Ho, Tu-Cheng (TW)

(73) Assignees: Avary Holding (Shenzhen) Co., Limited., Shenzhen (CN); HongQiSheng Precision Electronis (QinHuangDao) Co., Ltd., Qinhuangdao (CN)

( * ) Notice: Subject to any disclaimer, the term of this patent is extended or adjusted under 35 U.S.C. 154(b) by 0 days.

(21) Appl. No.: 15/990,767

(22) Filed: May 28, 2018

(65) Prior Publication Data

US 2018/0274869 A1 Sep. 27, 2018

Related U.S. Application Data

(62) Division of application No. 14/691,258, filed on Apr. 20, 2015, now Pat. No. 10,012,454.

(30) Foreign Application Priority Data

Sep. 2, 2014 (CN) ..... 2014 1 0442149

(51) Int. Cl.

| | |
|---|---|
| ***F28F 21/08*** | (2006.01) |
| ***F28F 3/04*** | (2006.01) |
| ***F28D 15/02*** | (2006.01) |

(52) U.S. Cl.

CPC ..... *F28F 21/085* (2013.01); *F28D 15/02* (2013.01); *F28F 3/048* (2013.01); *F28F 2275/025* (2013.01)

(58) Field of Classification Search

CPC ..... F28D 15/02; F28F 21/085

See application file for complete search history.

(56) References Cited

U.S. PATENT DOCUMENTS 5,697,428 A * 12/1997 Akachi ..... F28D 15/0233 165/104.14

2015/0101785 A1* 4/2015 Ho ..... F28F 21/085 165/170

FOREIGN PATENT DOCUMENTS

JP 03-273669 A * 12/1990

JP 2004-93127 A * 3/2004

OTHER PUBLICATIONS

Machine Translation Japanese Patent 2004-93127, Date Unknown.*

Machine Translation Japanese Patent 3-273669, Date Unknown.*

* cited by examiner

*Primary Examiner* — Jeffry H Aftergut

(74) *Attorney, Agent, or Firm* — ScienBiziP, P.C.

(57) ABSTRACT

A heat dissipation device includes etched or other grooves for adhesive surrounding etched or other recesses for heat-dissipating fluid, these being created in a first copper sheet and a second copper sheet brought together. The first copper sheet includes first recesses and the second copper sheet includes corresponding second recesses. The second copper sheet is adhesively fixed on the first copper sheet and an airtight receiving cavity is formed by the first and second recesses being brought together. The heat-dissipating fluid in the airtight receiving cavity carries away heat generated by a heat-producing device to which the heat-dissipating device is fixed.

15 Claims, 9 Drawing Sheets

HEAT DISSIPATION DEVICE

This application is a divisional application of a commonly-assigned application entitled "HEAT DISSIPATION DEVICE AND METHOD FOR MANUFACTURING SAME", filed on Apr. 20, 2015 with application Ser. No. 14/691,258. The disclosure of the above-identified application is incorporated herein by reference.

FIELD

The subject matter herein generally relates to heat dissipation device.

BACKGROUND

Since a high-power electronic device generates a large amount of heat during operation, both performance and lifetime of the electronic device are lowered if the heat cannot be dissipated in time.

BRIEF DESCRIPTION OF THE DRAWINGS

Implementations of the present technology will now be described, by way of example only, with reference to the attached figures.

DETAILED DESCRIPTION

Figure 1:
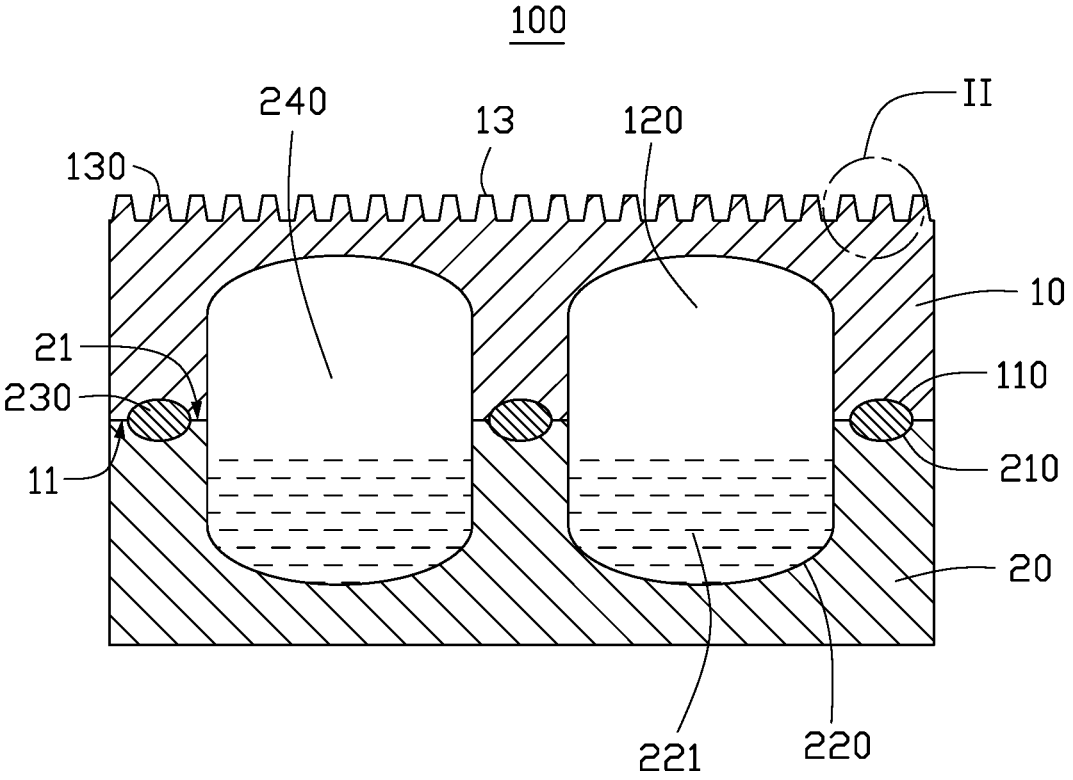
FIG. 1 is a diagrammatic view of a heat dissipation device comprising micro-fins in accordance with a first embodiment.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

Several definitions that apply throughout this disclosure will now be presented.

The term "substantially" is defined to be essentially conforming to the particular dimension, shape, or other feature that the term modifies, such that the component need not be exact. For example, "substantially cylindrical" means that the object resembles a cylinder, but can have one or more deviations from a true cylinder. The term "comprising," when utilized, means "including, but not necessarily limited to"; it specifically indicates open-ended inclusion or membership in the so-described combination, group, series and the like. The references "a plurality of" and "a number of" mean "at least two."

The present disclosure is described in relation to a heat dissipation device. The heat dissipation device includes a first copper sheet and a second copper sheet. The first copper sheet includes a number of first recesses; the second copper sheet includes a number of second recesses. The second recesses correspond with the first recesses and the second copper sheet is fixed on the first copper sheet. Each first recess and second recess together form an airtight receiving cavity and a working fluid is received in the airtight receiving cavity.

FIG. 1 illustrates a heat dissipation device 100 according to a first embodiment. The heat dissipation device 100 includes a first copper sheet 10, a second copper sheet 20, and an adhesive 230 configured for fixing the first copper sheet 10 and the second copper sheet 20 together.

Figure 2:
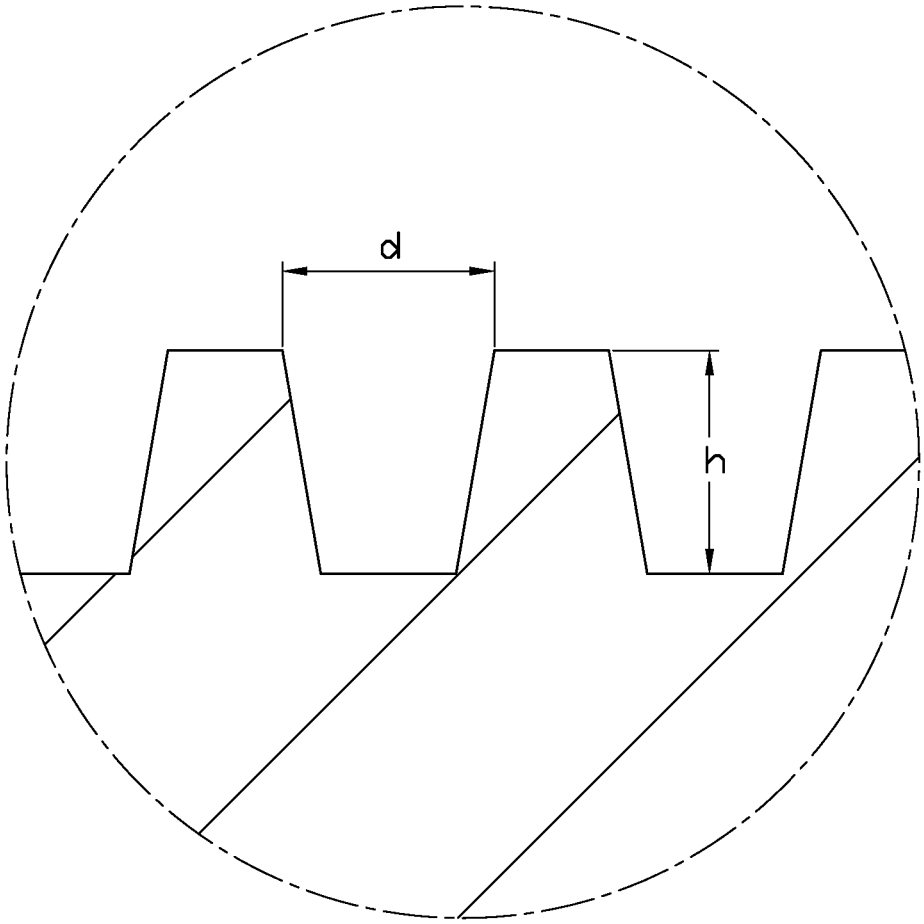
FIG. 2 is an enlarged view of the micro-fins of circled portion II in FIG. 1
Figure 3:
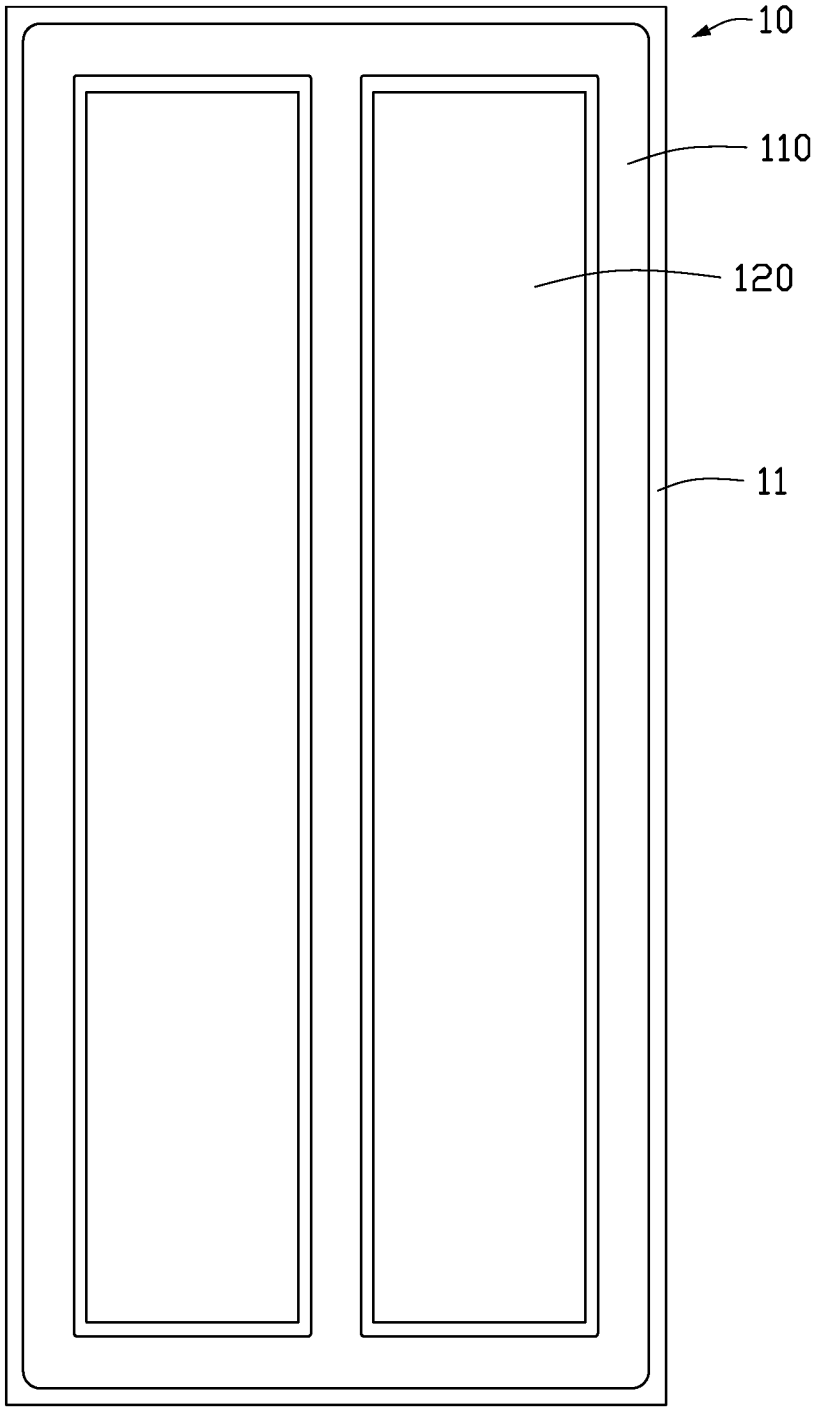
FIG. 3 is a top view of the heat dissipation device shown in FIG. 1.

The first copper sheet 10 includes a first surface 11 and a third surface 13 opposite to the first surface 11. The first surface 11 defines a number of first recesses 110 and a number of first cavities 120. Each first recess 110 is substantially a hemispherical groove surrounding each first cavity 120, as shown in FIG. 3. A depth of each first cavity 120 is less than a thickness of the first copper sheet 10. A plurality of micro-fins 130 is formed on the third surface 13. Each of the micro-fins 130 includes a top wall away from the third surface 13, and the top wall is flat. In the illustrated embodiment, a cross-section of the micro-fins 130 is substantially a trapezoid. A height of the trapezoid is in a range from about 3 um to 8 um, and a distance between adjacent micro-fins is in a range from about 30 to 40 um, as shown in FIG. 2.

The second copper sheet 20 has substantially the same size as the first copper sheet 10. The second copper sheet 20 includes a second surface 21 in contact with the first surface 11. The second surface 21 defines a number of second recesses 210 corresponding with the first recesses 110 and a number of second cavities 220 corresponding with the first cavities 120. Each second recess 210 is substantially a hemispherical groove surrounding each second cavity 220. A depth of each second recess 220 is less than a thickness of the second copper sheet 20. The second recesses 210 and the first recesses 110 have the same shape and size. The first recess 110 and the second recess 210 together are configured for receiving the adhesive 230. The first cavity 120 and the second cavity 220 together form an airtight receiving cavity 240 and are configured for receiving a working fluid 231.

A thickness of the first copper sheet 10 is about 140 um, a thickness of the second copper sheet 20 is also about 140 um.

In the illustrated embodiment, the adhesive 230 is low temperature solder paste, a melting point of the low temperature solder paste being about 139° C. or less.

The working fluid 221 can be selected from a group comprising water, methanol, ethanol, acetone, ammonia, paraffin, oil, and chlorofluorocarbons. In the illustrated embodiment, the working fluid 221 is water. A heat capacity of water is about $4.2\times10^3$ J/(kg·° C.), which is larger than heat capacity of copper in sheet form.

When the heat dissipation device 100 is used for heat dissipation, the heat dissipation device 100 is fixed to a heat generating member of an electronic device (not shown). The heat generating member can be a CPU or other device. Heat generated by the heat generating member is transferred to and gathered at bottom of the second copper sheet 20, and the heat is absorbed by the working fluid 221 in the receiving cavity 240. Such heat is diffused through the second copper sheet 20 and the first copper sheet 10. The working fluid 221 is gradually vaporized and the vapor is moved to an inner wall of the first cavity 120, where it condenses into small droplets. Finally the small droplets drop into the second cavity 220, thereby heat generated from the heat generating member of the electronic device is dissipated.

Figure 4:
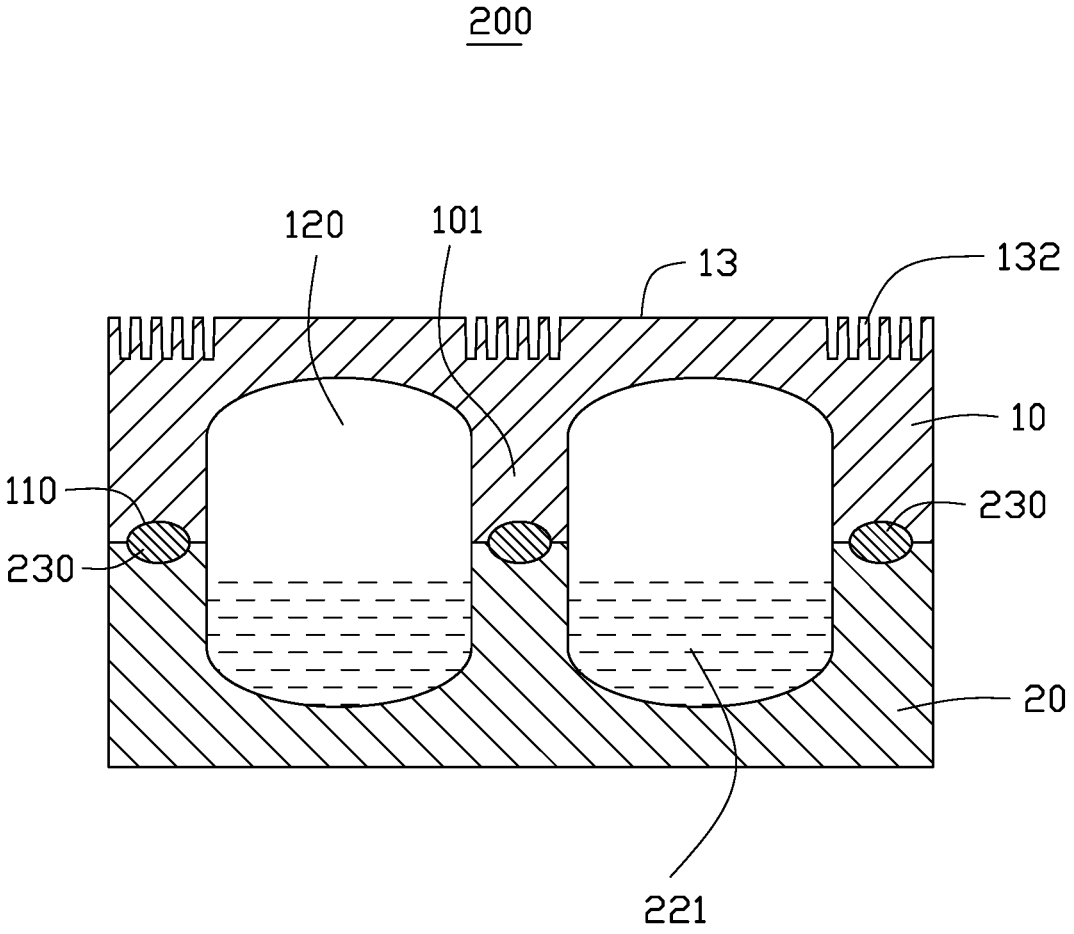
FIG. 4 is a diagrammatic view of a heat dissipation device in accordance with a second embodiment.

FIG. 4 illustrates a heat dissipation device according to a second embodiment (heat dissipation device 200). The structure of the heat dissipation device 200 is similar to that of heat dissipation device 100. The difference is that: the first copper sheet 10 includes a plurality of ribs 101 between each first cavity 120, and the micro-fins 132 are formed on the third surface 13 immediately above the ribs 101.

Figure 5:
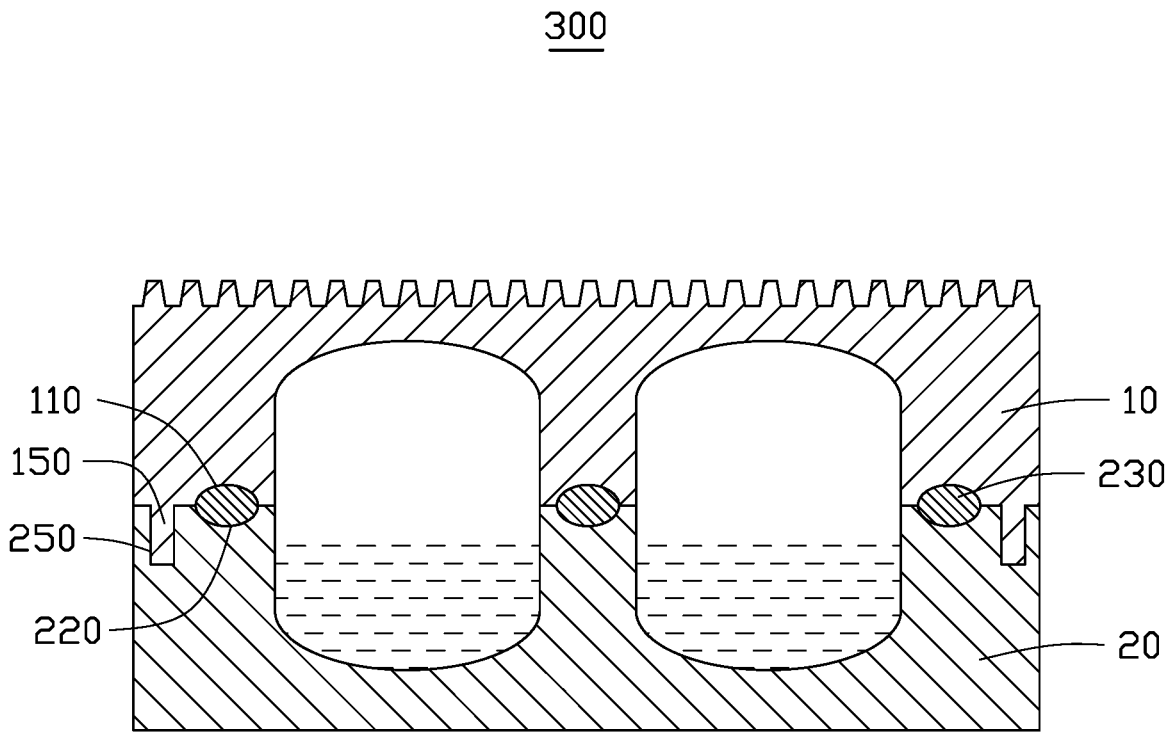
FIG. 5 is a diagrammatic view of a heat dissipation device in accordance with a third embodiment.

FIG. 5 illustrates a heat dissipation device according to a third embodiment (heat dissipation device 300). The structure of the heat dissipation device 300 is similar to that of heat dissipation device 100. The difference is that the first copper sheet 10 includes at least one position post 150 and the second copper sheet 20 includes at least one position hole 250, the position post 150 matching with the position hole 250 and being received in the position hole 250. The position post 150 and position hole 250 are configured to locate and fix the first copper sheet 10 and the second copper sheet 20 together and prevent the first copper sheet 10 from deviating relative to the second copper sheet 20.

Figure 6:
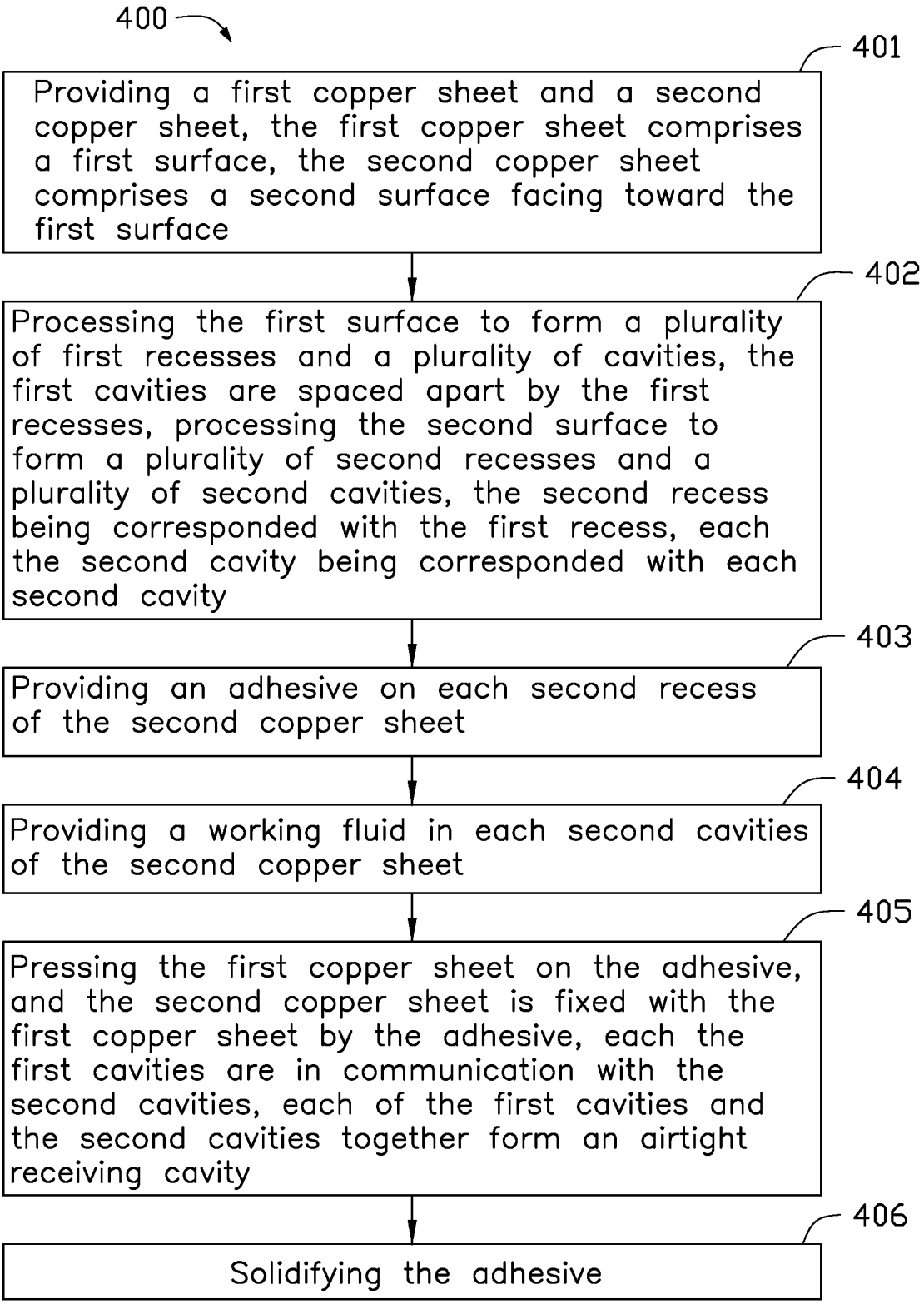
FIG. 6 illustrates a flowchart of a method for manufacturing the heat dissipation device of FIG. 1.
Figure 7:
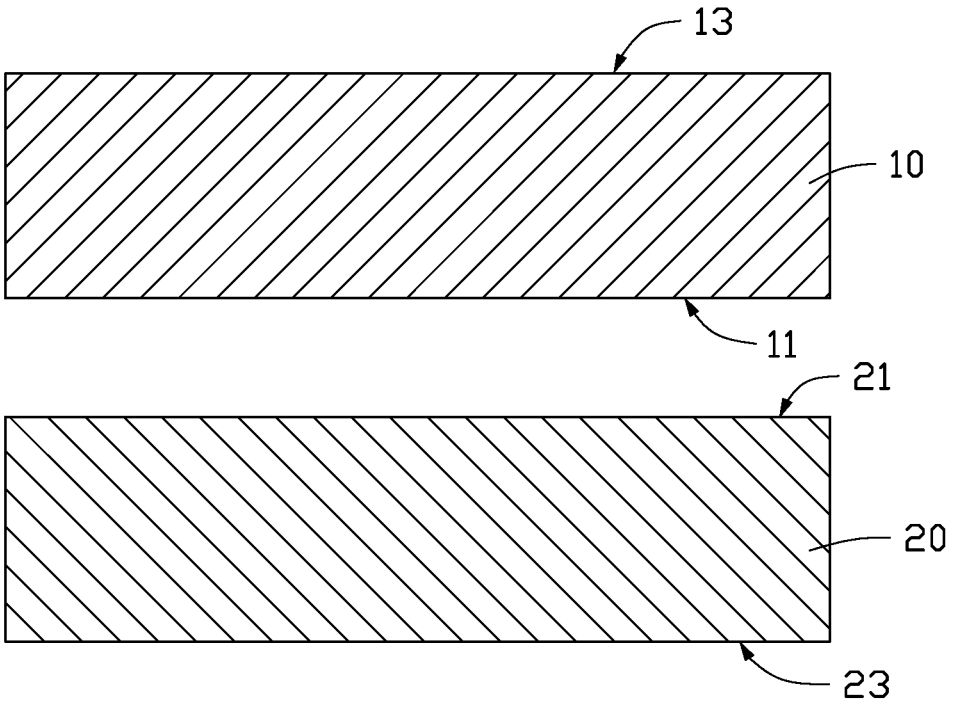
FIG. 7 illustrates a diagrammatic view of a first copper sheet and a second copper sheet provided for manufacturing a heat dissipation device.

FIG. 6 illustrates a flowchart of a method in accordance with an example embodiment. The example method 400 is for manufacturing a heat dissipation device. Heat dissipation device 100 (shown in FIG. 1) is provided by way of an example, as there are a variety of ways to carry out the method. The illustrated order of blocks is by example only and the order of the blocks can change. The method 400 can begin at block 401.

Figure 8:
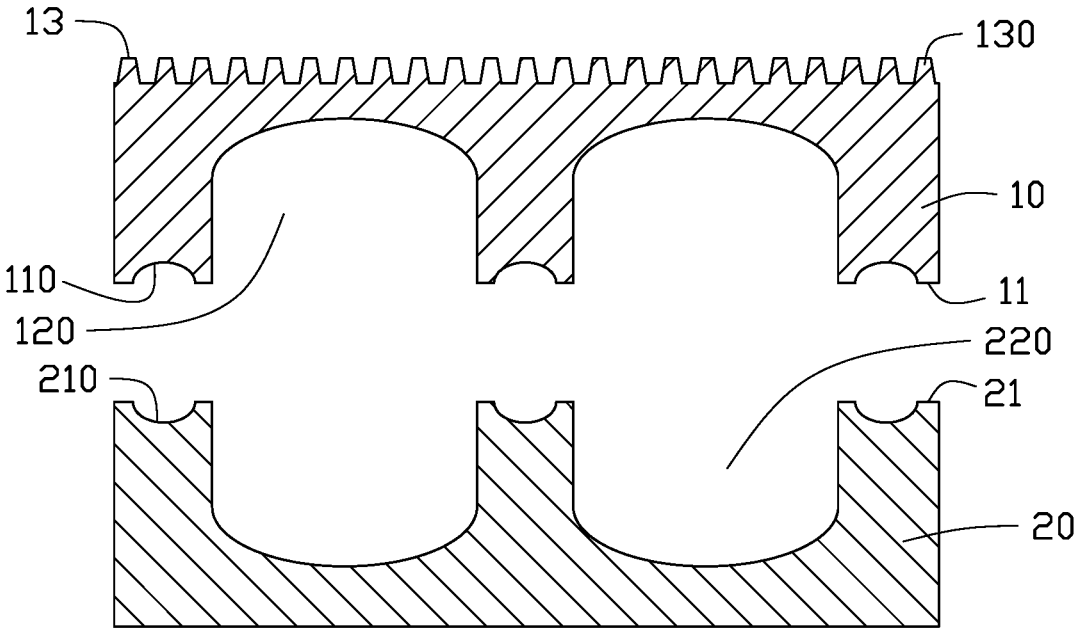
FIG. 8 is a diagrammatic view of first and second surfaces processed to form pluralities of recesses and cavities.

At block 401, a first copper sheet 10 and a second copper sheet 20 are provided, as shown in FIG. 8. In the embodiment, the first copper sheet 10 and the second copper sheet 20 are substantially rectangular. The first copper sheet 10 includes a first surface 11 and a third surface 13 opposite to the first surface 11. The second copper sheet 20 includes a second surface 21 facing the first surface 11 and a fourth surface opposite to the second surface 23. A thickness of the first copper sheet 10 is the same as that of the second copper sheet 20. In the embodiment, the thickness of the first copper sheet 10 is about 140 um.

At block 402, the first surface 11 is etched to form a number of first recesses 110. The third surface 13 is etched to form a number of micro-fins 130, and the second surface 21 is etched to form a number of second recesses 210 and a number of cavities 220, as shown in FIG. 8. The second cavities 220 and the first cavities 120 have the same shape and size. A cross section of the first and second recesses 120 and 220 is arc-shaped or a semicircle-shaped. The first cavities 120, the second cavities 220 and the micro-fins 130 can be etched using a chemical solution or laser beam.

The cross section of the micro-fins 130 is substantially trapezoidal. A height of the trapezoid is in a range from about 3 to 8 um, and a width of the trapezoid is in a range from about 30 to 40 um. The trapezoidal shape of the micro-fins 130 on the third surface 13 increases their structural strength.

Figure 9:
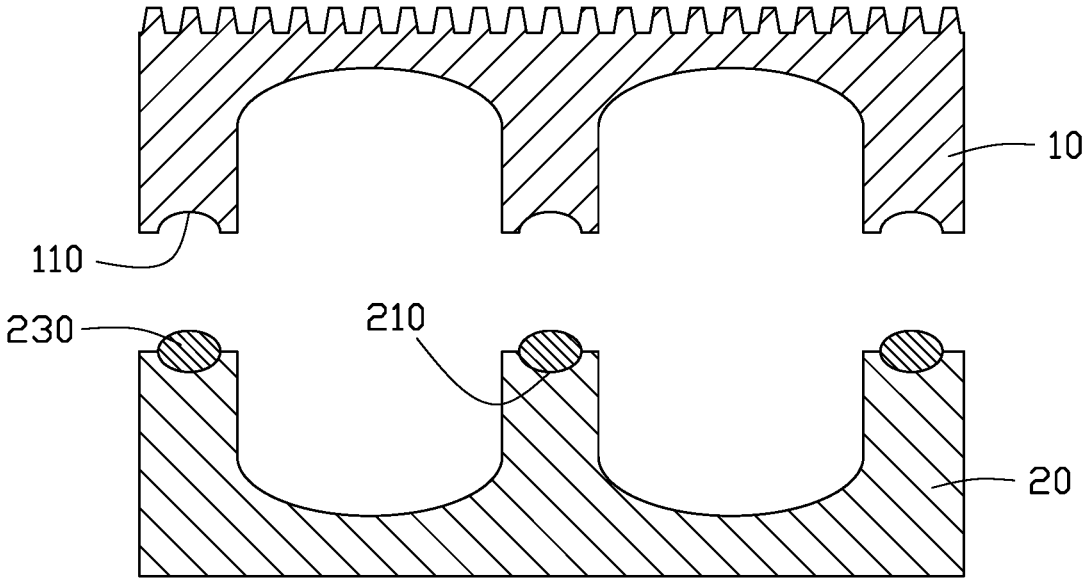
FIG. 9 is a diagrammatic view of an adhesive infilled on the second copper sheet in FIG. 7.

At block 403, an adhesive 230 is applied in the second recess 210 of the second copper sheet 10, as shown in FIG. 9. A melting point of the adhesive 230 is about 139 degrees or less, but higher than a boiling point of water. That is to say, when water is used for absorbing heat, the adhesive 230 will not melt. In the illustrated embodiment, the adhesive 230 is applied by a screen printing process.

The adhesive 230 is mainly comprised of resin material mixed with metal particles. The metal particles are selected from the group consisting of copper, silver, tin, bismuth and any combination thereof. A diameter of the metal particles is about from 25 to 45 um, a weight content of the metal particles is about 89.1 wt %-89.7 wt %, a weight content of the resin material is about 10.3 wt %-10.9 wt %. Preferably, the metal particles are Sn64AgBi35 alloy. The adhesive 230 with the above proportions has a better adhesion and is more waterproof.

Figure 10:
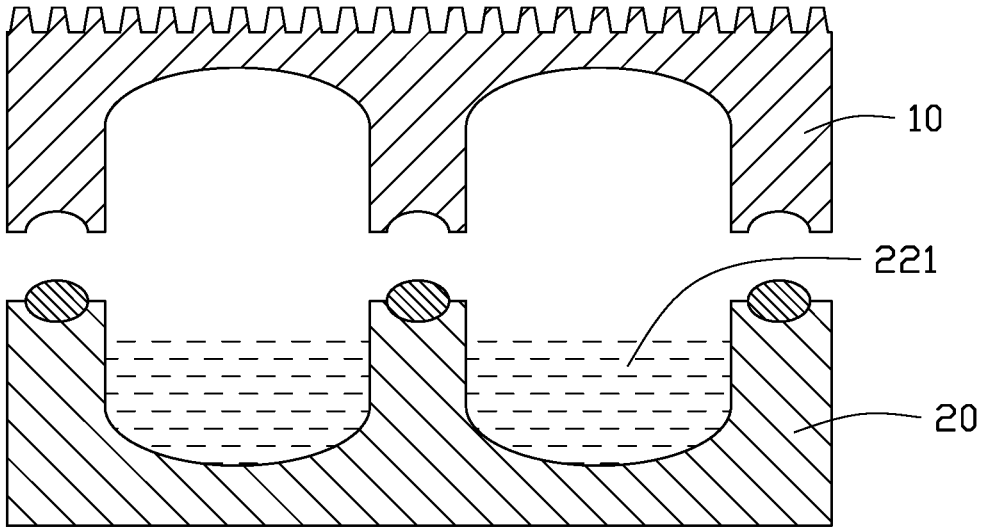
FIG. 10 is a diagrammatic view of a working fluid received in the second copper sheet of FIG. 7.

At block 404, a working fluid 221 is infilled into the second recesses 220, as shown in FIG. 10. The working fluid 221 can be selected from a group comprising water, methanol, ethanol, acetone, ammonia, paraffin, oil, and chlorofluorocarbons. In the illustrated embodiment, the working fluid 221 is water.

Figure 11:
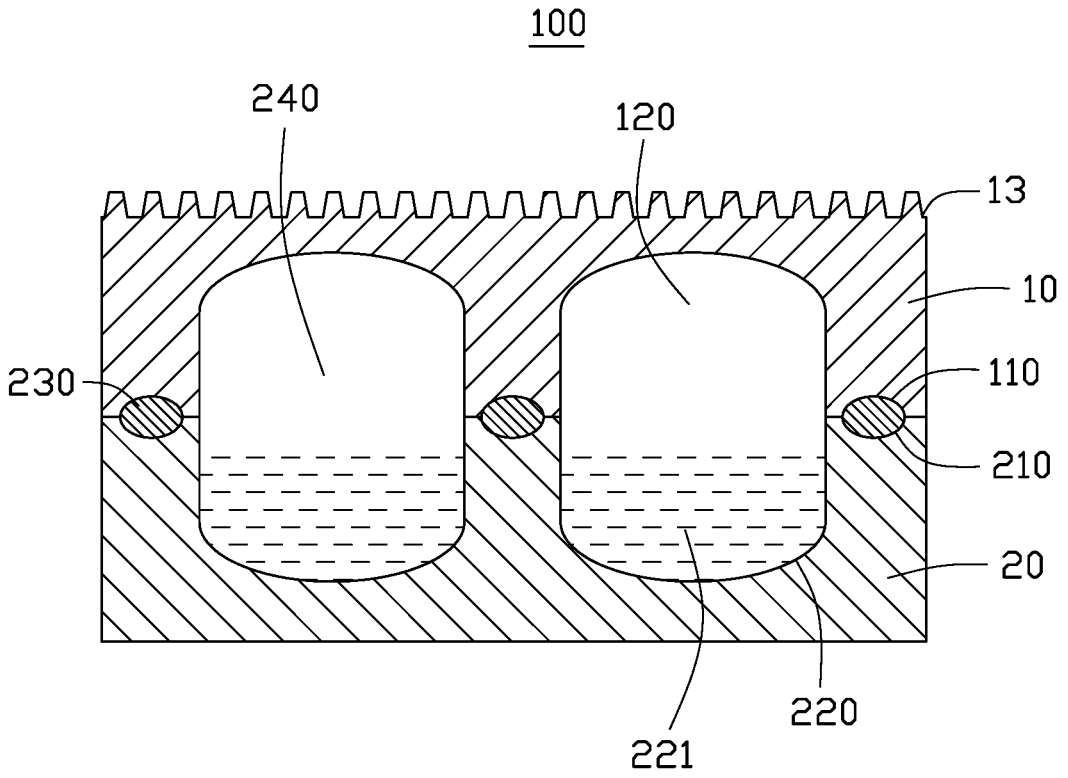
FIG. 11 is a diagrammatic view of the first and second copper sheets of FIG. 7 fixed together.

At block 405, the first copper sheet 10 is pressed on the second copper sheet 20 and the second copper sheet 20 is fixed with the first copper sheet 10 by the adhesive 230, as shown in FIG. 11. Each of the first recesses 120 corresponds to and is in communication with one second recess 220. When fixed together, each first recess 120 and second recess 220 together form an airtight receiving cavity 404.

At block 406, the adhesive 230 is solidified to fix the second copper sheet 20 with the first copper sheet 10, and obtain a heat dissipation device 100.

The embodiments shown and described above are only examples. Therefore, many such details are neither shown nor described. Even though numerous characteristics and advantages of the present technology have been set forth in the foregoing description, together with details of the structure and function of the present disclosure, the disclosure is illustrative only, and changes may be made in the detail, including in matters of shape, size, and arrangement of the parts within the principles of the present disclosure, up to and including the full extent established by the broad general meaning of the terms used in the claims. It will therefore be appreciated that the embodiments described above may be modified within the scope of the claims.

What is claimed is:

1. A heat dissipation device comprising:

a first copper sheet comprising a plurality of first recesses and a plurality of first cavities;

a second copper sheet comprising a plurality of second recesses and a plurality of second cavities, the second recesses respectively corresponding with the first recesses, the first cavity respectively corresponding with the second cavity, the first and the second recesses being filled with adhesive, the second copper sheet being fixed on the first copper sheet with the adhesive and each the second cavities being in communication with the corresponding first cavities, a number of airtight receiving cavities being formed by each of the first cavities and the second cavities; wherein the first copper sheet comprises a first surface and a third surface opposite to the first surface, the first surface defines the first cavities and the first recesses, the third surface defines a plurality of micro-fins, the second copper sheet comprises a second surface facing the first surface, the second surface defines the pluralities of the second recesses and the second cavities, wherein each of the airtight receiving cavities is configured to receive working fluid.

2. The heat dissipation device of claim 1, wherein each of the micro-fins comprises a top wall away from the third surface, and the top wall is flat.

3. The heat dissipation device of claim 2, wherein a cross section of each of the micro-fins is substantially a trapezoid.

4. The heat dissipation device of claim 2, wherein a height of the trapezoid is in a range from 3 um to 8 um.

5. The heat dissipation device of claim 2, wherein a width of the trapezoid is in a range from 30 um to 40 um.

6. The heat dissipation device of claim 1, wherein the adhesive is low temperature solder paste.

7. The heat dissipation device of claim 6, wherein the adhesive comprises a molten resin material doped with metal particles, the metal particle is selected from the group comprising tin, bismuth and any combination thereof.

8. The heat dissipation device of claim 7, wherein a weight content of the metal particles in the adhesive is in a range from 89.1% to 89.7%, and a weight ratio of molten resin in the adhesive is in the range from 10.3% to 10.9%.

9. The heat dissipation device of claim 2, wherein each of the micro-fins is formed at a location of the third surface corresponding to the first recess.

10. The heat dissipation device of claim 1, wherein the first surface of the first copper sheet is formed at least one position post, the second copper sheet defines at least one position hole, the position post matches with the position hole and is received in the position hole.

11. The heat dissipation device of claim 1, wherein a cross section of each of the first and the second cavities is an arc or a semi circle.

12. The heat dissipation device of claim 1, wherein a depth of the first recess is less than a depth of the first cavity, a depth of the second recess is less than a depth of the second cavity.

13. The heat dissipation device of claim 1, wherein a thickness of the first copper sheet is 140 um.

14. The heat dissipation device of claim 1, wherein a thickness of the second copper sheet is 140 um.

15. The heat dissipation device of claim 1, wherein each the first recess is a hemispherical groove surrounding each of the first cavity.

* * * * *